United States Patent [19]
Sung

[11] Patent Number: 4,477,261
[45] Date of Patent: Oct. 16, 1984

[54] POLYETHER AMINO-AMIDE COMPOSITION AND MOTOR FUEL COMPOSITION CONTAINING SAME

[75] Inventor: Rodney L. Sung, Fishkill, N.Y.

[73] Assignee: Texaco Inc., White Plains, N.Y.

[21] Appl. No.: 540,588

[22] Filed: Oct. 11, 1983

[51] Int. Cl.³ ..... C10L 1/22
[52] U.S. Cl. ..... 44/63; 44/71; 44/77; 564/193; 548/353
[58] Field of Search ..... 44/63, 71, 77; 564/193; 548/353

[56] References Cited

U.S. PATENT DOCUMENTS

| | | | |
|---|---|---|---|
| 3,437,466 | 4/1969 | Betty et al. | 44/71 |
| 4,298,352 | 11/1981 | Blysing | 44/77 |
| 4,305,731 | 12/1981 | Sung et al. | 44/63 |

*Primary Examiner*—Y. Harris-Smith
*Attorney, Agent, or Firm*—Robert A. Kulason; James F. Young; James J. O'Loughlin

[57] ABSTRACT

This invention relates to a polyether amino amide additive and to a motor fuel composition containing same which inhibits ORI and has good carburetor detergency properties. The additive is represented by the formula:

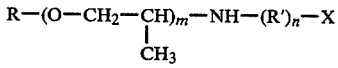

in which R is a hydrocarbyl radical having from 6 to 18 carbon atoms, m is a integer from 2 to 4, R′ is divalent alkylene radical having from 2 to 3 carbon atoms, n is 1 or 2, and X is a radical from the group consisting of:

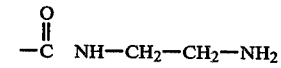

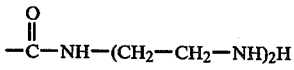

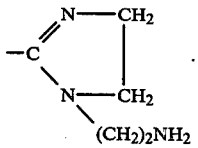

The present invention is also directed to a gasoline motor fuel composition having a reduced ORI and good carburetor detergency properties which composition contains a minor account of at least one of the above compounds.

10 Claims, No Drawings

POLYETHER AMINO-AMIDE COMPOSITION AND MOTOR FUEL COMPOSITION CONTAINING SAME

BACKGROUND OF THE INVENTION

Field of the Invention

This invention relates to a novel composition of matter and to fuel compositions containing same which exhibit carburetor detergency and inhibit or prevent the accumulation and build-up of carbon deposits in the combustion chamber of a spark ignited internal combustion engine.

The presence of carbon deposits in the combustion chamber of an engine interferes with the operating efficiency of the engine. The heated carbon deposits tend to serve as an unwanted ignition source causing pre-ignition of the fuel. In addition, these carbon deposits tend to reduce the available combustion space in the chamber causing, as an end result, an increase in the octane requirement of an engine (ORI).

The pre-ignition phenomenon is caused by the hot accumulated carbon deposits which cause an early ignition of the fuel-air mixture. Because the fuel is burned in an uncontrolled fashion, the engine will tend to knock. Under these conditions, the energy of combustion is not being effectively harnessed. Moreover, a prolonged period of pre-ignition can cause stress fatigue and wear in vital parts of the engine.

The octane requirement increase phenomenon is caused by accumulated carbon deposits which reduce the available space in the combustion chamber during the compression of the fuel-air mixture. As a result, a higher than design compression ratio is obtained and higher octane fuels are required for the engine to run satisfactorily. However, higher octane fuels are expensive and it would be advantageous if the deposition of carbon deposits in the combustion chamber of the engine could be reduced or prevented.

Heretofore, there has been no satisfactory method for preventing both pre-ignition and octane requirement increase in an internal combustion engine. However, with the instant invention, applicant have discovered motor fuel additives which by preventing or reducing the accumulation of carbon deposits in the combustion chamber effectively prevent both pre-ignition and octane requirement increase.

It is an object of the present invention to provide a motor fuel additive which will prevent or reduce the accumulation of carbon deposits in the combustion chamber of an internal combustion engine.

It is another object of the present invention to provide a motor fuel composition which will inhibit or prevent engine misfiring or engine knock.

It is still another object of the present invention to provide a motor fuel composition having good carburetor detergency properties.

INFORMATION DISCLOSURE STATEMENT

Co-assigned U.S. application Ser. No. 291,583 discloses an alcohol extended motor fuel composition having therein additives comprising glycine derivatives of an alkyl amino-amide to provide anti-friction and anti-corrosion properties to the fuel mixture.

Co-assigned U.S. application Ser. No. 388,197 discloses a motor fuel having therein additives comprising an alkyl alkoxy amino acid to provide detergency properties to the fuel mixture.

U.S Pat. No. 3,437,466 discloses hydrocarbon fluids, such as gasoline, having therein additives comprising aliphatic aminopropionamides to precipitate particulate matter suspensions in the hydrocarbon mixture.

SUMMARY OF THE INVENTION

This invention relates to a polyether amino amide additive and to a motor fuel composition containing same which inhibits ORI and has good carburetor detergency properties. The additive is represented by the formula:

$$R-(O-CH_2-\underset{\underset{CH_3}{|}}{CH})_m-NH-(R')_n-X$$

in which R is a hydrocarbyl radical having from 6 to 18 carbon atoms, m is a integer from 2 to 4, R' is divalent alkylene radical having from 2 to 3 carbon atoms, n is 1 or 2, and X is a radical from the group consisting of:

$$-\overset{\overset{O}{\|}}{C}-NH-CH_2-CH_2-NH_2$$

$$-\overset{\overset{O}{\|}}{C}-NH-(CH_2-CH_2-NH)_2H$$

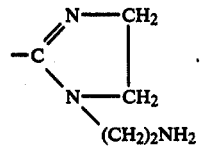

Preferably, R is an alkyl group of 10 to 12 carbons, m is 2, R' is ethylene, and n is 1.

The present invention is also directed to a gasoline motor fuel composition having a reduced ORI and good carburetor detergency properties which composition contains a minor amount of at least one of the above compounds.

DETAILED DESCRIPTION OF THE INVENTION

The additive of the instant invention is a polyether amino-amide which comprises the formula:

$$R-(O-CH_2-\underset{\underset{CH_3}{|}}{CH})_m-NH-(R')_n-X$$

in which R is a hydrocarbyl radical having from 6 to 18 carbon atoms, m is a integer from 2 to 4, R' is divalent alkylene radical having from 2 to 3 carbon atoms, n is 1 or 2, and X is a radical from the group consisting of:

$$-\overset{\overset{O}{\|}}{C}-NH-(CH_2-CH_2-NH)_2H$$

$$-\overset{\overset{O}{\|}}{C}-NH-(CH_2-CH_2-NH)_2H$$

-continued

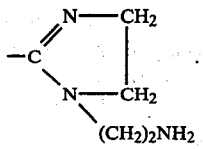

Examples of suitable polyether amino-amides that can be employed in the instant invention include $C_{10}$–$C_{12}$ diisopropoxy β-aminopropylamide of ethylene diamine, $C_{10}$–$C_{12}$ diisopropoxy β-aminopropylamide of diethylene triamine, and 2-($C_{10}$–$C_{12}$ diisopropoxyl β-aminoethyl)1-aminoethyl imidazoline, octadecyl diisopropoxy β-aminopropylamide of ethylene diamine, octadecyl diisopropoxy β-aminopropylamide of ethylene diamine, octadecyl diisopropoxy β-aminopropylamide of diethylene triamine, 2-(octadecyl diisopropoxyl β-aminoethyl) 1-aminoethyl imidazoline, octadecyl triisopropoxy β-aminopropylamide of ethylene diamine, octadecyl triisopropoxy β-aminopropylamide of diethylene triamine, 2-(octadecyl triisopropoxy β-aminoethyl) 1-aminoethyl imidazoline, and the like. The preferred polyether amino-amides are $C_{10}$–$C_{12}$ diisopropoxy β-aminopropylamide of ethylene diamine, $C_{10}$–$C_{12}$ diisopropoxy β-aminopropylamide of diethylene triamine, and 2-($C_{10}$–$C_{12}$ diisopropoxy β-aminoethyl) 1-aminoethyl imidazoline.

To prepare the polyether amino-amide additive of the instant invention, substantially equal mole amounts of a polyether amino acid is reacted with ethylene diamine or diethylene triamine. The polyether amino acid reactant is represented by the formula:

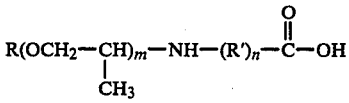

wherein R is a hydrocarbyl group having from about 6 to 18 carbon atoms, m is an integer from 2 to 4, R′ is a divalent alkylene radical having 2 to 3 carbon atoms and n is 1 or 2.

The reaction can be conducted neat or in solution in a suitable solvent. The reaction can be conducted at room temperature or at an elevated temperature up to the decomposition temperature of the reactants or the product. In general, the reaction is conducted at the reflux temperature of the solvent and continued until the formation of the amide is complete, that is, until no further water is given off. Preferably a solvent such as xylene is present during the reaction.

Preferred as the acid reactant is a polyether amino-propionic acid represented by the formula:

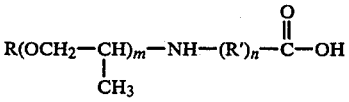

wherein R is an alkyl group to 10 to 12 carbon atoms, R′ is ethylene, n is 1, and m is 2. Suitable propionic acids are sold by the Texaco Chemical Co. under the trademark Jeffamine Surfactant MA-300.

The polyether amino-amide additive of the invention can be added to a gasoline fuel composition in amounts of 5 to 200 pounds per 1000 barrels of fuel and preferably from 5 to 50 pounds per 1000 barrels of fuels.

The gasoline base fuel will in general comprise a mixture of hydrocarbons, including paraffinic, straight-chain, aromatic, and olefinic hydrocarbons, which boil at a temperature from about 75° F. to 450° F. Hydrocarbons boiling in the gasoline boiling range can be obtained naturally or they can be produced by thermal or catalytic cracking and/or by reforming of petroleum hydrocarbons. The base fuel will generally have a Research Octane Number of about 85 to 102 with the preferred range being about 90 to 100.

The Examples given below illustrate the novel polyether amino-amide compound of the invention and its use in a motor composition. Unless otherwise specified, all proportions are given by weight.

EXAMPLE 1

Preparation of $C_{10}$–$C_{12}$ Diisopropoxy β-Aminopropylamide of Ethylene Diamine To 177.6 parts of a polyether aminopropionic acid having the formula:

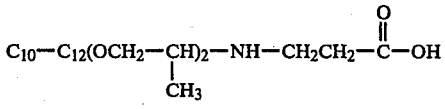

(which is readily available from Texaco Chemical Company under the trademark Surfactant MA-300 and will be hereinafter referred to as such) dissolved in 400 parts of xylene, 12 parts of ethylene diamine were added. This mixture was reacted at the reflux temperature of xylene. After all of the water of reaction was distilled off (or removed), heating was stopped and the reaction product was filtered and stripped of the remaining solvent under a vacuum. Elemental analysis, IR analysis, and NMR analysis confirmed that the product was $C_{10}$–$C_{12}$ diisopropoxy β-aminopropylamide of ethylene diamine having the following formula:

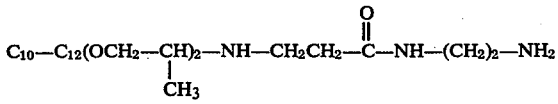

EXAMPLE 2

Preparation of $C_{10}$–$C_{12}$ Diisopropoxy β-Aminopropylamide of Diethylene Triamine To 169.3 parts of Surfactant MA-300 dissolved in 520 parts of xylene and 140 parts of dimethyl formamide, 20.6 parts of diethylene triamine were added. This mixture was reacted at the reflux temperature of the xylene. After one mole of water of reaction was distilled off (or removed), heating was stopped and the reaction product was filtered and stripped of the remaining solvent under a vacuum. Elemental analysis, IR analysis, and MNR analysis confirmed that the product was $C_{10}$–$C_{12}$ diisopropoxy β-aminopropylamide of diethylene triamine having the following formula:

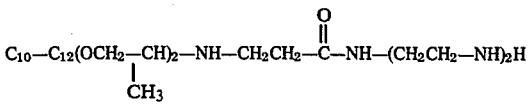

EXAMPLE 3

Preparation of 2-($C_{10}$–$C_{12}$ Diisopropoxy β-Aminethyl) 1-aminoethyl Imidazoline To 169.2 parts of Surfactant MA-300 dissolved in 520 parts of xylene and 140 parts of dimethyl formamide, 20.6 parts of diethylene triamine were added. This mixture was reacted at the reflux temperature of the xylene. After all the water of reaction was distilled off (or removed), heating was stopped and the product was filtered and stripped of the remaining solvent under a vacuum. Elemental analysis, IR analysis, NMR analysis, confirmed that the product was 2-($C_{10}$–$C_{12}$ diisopropoxy β-aminoethyl) 1-aminoethyl imidazoline having the following formula:

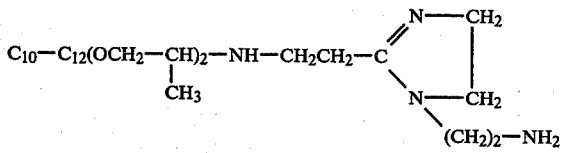

EXAMPLE 4

To 250 parts of octadecyl diisopropoxy β aminopropionic acid dissolved in 400 parts of xylene, 30 parts of ethylene diamine are added. The reaction mixture is reacted at the reflux temperature of xylene. After the water of reaction is distilled off (or removed), heating is stopped and the product is cooled, filtered and stripped of the remaining solvent under a vacuum.

EXAMPLE 5

To 279 parts of octadecyl triisopropoxy β-aminopropionic acid dissolved in 400 parts of xylene, 30 parts of ethylene diamine are added. The mixture is reacted at the reflux temperature of xylene. After the water of reaction is distilled off (or removed), heating is stopped and the mixture is cooled, filtered and stripped of the remaining solvent under a vacuum.

The fuel additive of the instant invention was tested for its carburetor detergency property in the Chevrolet Carburetor Detergency Test. This test is run on a Chevrolet V-8 engine mounted on a test stand using a modified 4-barrel carburetor. The two secondary barrels of the carburetor are sealed and the feed to each of the primary barrels arranged so that an additive fuel can be run in one barrel and the base fuel run in the other. The primary carburetor barrels were modified so that they had removable aluminum inserts in the throttle plate area in order that deposits formed on the inserts in this area could be conveniently weighed on removal of the inserts.

In a procedure designed to determine the effectiveness of a fuel additive to remove formed deposits in the carburetor, the engine is run for a period of usually 24 to 48 hours using the base fuel as the feed to both barrels with engine blowby circulated to an inlet in the carburetor body. The weight of the deposits on both inserts is determined and reported. The engine is then cycled for an additional 24 hours with a suitable reference fuel being fed to one barrel and the additive fuel to the second barrel with blowby into the air inlet in the carburetor body. After this cycle, the inserts are removed from the carburetor and weighed to determine the weight of the deposits and the difference in the performance of the additive and the reference fuels for removing preformed deposits. After the aluminum inserts have been cleaned, they are replaced in the carburetor throat and the process is repeated with the fuels reversed in the carburetor inlets and the test is repeated. This serves to minimize any difference in fuel distribution and barrel construction. The deposit weights are averaged and the effectiveness of the fuel composition of the invention is compared to the reference fuel which contains a commercial detergent additive. The difference in effectiveness is expressed in percent.

The results of the conducted test are given in the table below:

TABLE I

CHEVROLET CARBURETOR DETERGENCY TEST[1]

| Run | Additive | PTB[2] | Difference in the Percentage of Deposits Washed Down (removed)[3] |
|---|---|---|---|
| 1 | $C_{10}$–$C_{12}$ diisopropoxy β-aminopropylamide of ethylene diamine, Example I | 20 | +0.5 |
| 2 | $C_{10}$–$C_{12}$ diisopropoxy β-aminopropylamide of diethylene triamine, Example II | 20 | −0.5 |
| 3 | 2-($C_{10}$–$C_{12}$ diisopropoxy β-aminoethyl) 1-aminoethyl imidazoline, Example III | 20 | −0.5 |

[1]As a test standard, a base unleaded fuel containing a commercial carburetor detergent additive is employed.
[2]Pounds per Thousand Barrels of Fuel
[3]This number represents the difference between the percentage of preformed deposits washed down by the fuel containing the test additive and the percentage of preformed deposits washed down by the fuel containing the commercial carburetor detergent. A positive number means that the additive is more effective than the commercial detergent gasoline.

These data demonstrate that all three of the preferred additives of the invention perform satisfactorily as carburetor detergents in unleaded gasoline.

The polyether amino-amide of the invention was tested in the Combustion Chamber Deposit Screening Test (CCDST) to determine whether the additive was effective as a deposit control additive to prevent octane requirement increase. In this test, the additive sample is dissolved in unleaded gasoline to a concentration of 100 pounds per thousand barrels. In a nitrogen/air environment the gasoline is then atomized and sprayed onto a heated aluminum tube. After 100 minutes, the deposits which have formed on the tube are weighed. Gasolines which exhibit the property of forming larger amounts of deposits on the heated aluminum tube cause the greatest octane requirement increase when employed in an internal combustion engine.

The results are given below:

TABLE II

COMBUSTION CHAMBER DEPOSIT SCREENING TEST

| Run | Additive | Deposit[1] wt. (mg) | Low Ref. | High Ref. |
|---|---|---|---|---|
| 1 | 100 PTB $C_{10}$–$C_{12}$ diisopropoxy β-aminopropylamide of ethylene diamine, Example I | 6.8 | 6 | 12.1 |
| 2 | 100 PTB $C_{10}$–$C_{12}$ diisopropoxy β-aminopropylamide of diethylene triamine, Example II | 5.5 | 6 | 12.1 |
| 3 | unleaded base fuel | 5 | 6 | 12.1 |

[1]Deposit weights of greater than 10 to 12 mg indicate that the additive is not a satisfactory octane reducing agent The foregoing data illustrate that motor fuel compositions of the invention containing the prescribed additive as shown in Runs 1 and 2 above are satisfactory deposit control agents.

Included within the scope of the invention are gasolines containing the usual amount of conventional additives present in amounts necessary to fulfill their functions therein. Accordingly, dyes, corrosion inhibitors, anti-oxidants and the like, can be beneficially employed in the fuels of the invention without materially affecting the novel additive of the invention.

It is unexpected and surprising that the polyether amino-amide compounds of the invention perform both as carburetor detergents and as deposit control (octane requirement reducing) agents in unleaded gasoline fuels.

What is claimed:

1. A novel composition represented by the formula:

$$R-(O-CH_2-\underset{\substack{|\\ CH_3}}{CH})_m-NH-(R')_n-X$$

in which R is a hydrocarbyl radical having from 6 to 18 carbon atoms, m is an integer from 2 to 4, R' is a divalent alkylene radical having from 2 to 3 carbon atoms, n is 1 or 2 and X is a radical from the group consistig of:

$$-\overset{O}{\overset{\|}{C}}-NH-CH_2CH_2-NH_2,$$

$$-\overset{O}{\overset{\|}{C}}-NH-(CH_2-CH_2-NH)_2H,$$

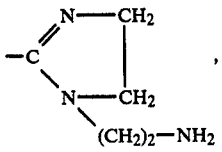

2. The compound of claim 1, wherein R is an alkyl group of 10 to 12 carbon atoms, R' is ethylene, X is $-NH-(CH_2)_2-NH_2$, n is 1, and m is 2.

3. The compound of claim 1, wherein R is an alkyl group of 10 to 12 carbon atoms, R' is ethylene, X is $-NH-(CH_2-CH_2-NH)_2H$, n is 1, and m is 2.

4. The compound of claim 1, wherein R is an alkyl group 10 to 12 carbon atoms, R' is ethylene,

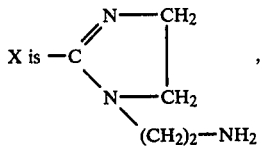

n is 1 and m is 2.

5. A motor fuel composition containing an effective carburetor detergent amount of the composition of claim 1.

6. The composition of claim 5, wherein said compound is present in an amount ranging from about 5 to 200 pounds per thousand barrels of gasoline.

7. The composition of claim 5, wherein said compound is present in an amount ranging from about 5 to 50 pounds per thousand barrels of gasoline.

8. The composition of claim 5, wherein in said compound R is an alkyl group of 10 to 12 carbon atoms, R' is ethylene, X is $-NH-(CH_2)_2-NH_2$, n is 1 and m is 2.

9. The composition of claim 5, wherein in said compound R is an alkyl group of 10 to 12 carbon atoms, R' is ethylene, X is $-NH-(CH_2-CH_2-NH)_2H$, n is 1 and m is 2.

10. The composition of claim 5, wherein in said compound R is an alkyl group of 10 to 12 carbon atoms, R' is ethylene, x is

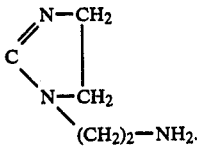

n is 1 and m is 2.

* * * * *